US006123370A

United States Patent [19]

Rozema et al.

[11] Patent Number: 6,123,370

[45] Date of Patent: Sep. 26, 2000

[54] INCREASED STRENGTH DOGGING MECHANISM

[75] Inventors: Timothy S. Rozema, Irvine; William S. Meineke, Riverside, both of Calif.

[73] Assignee: Hartwell Corporation, Placentia, Calif.

[21] Appl. No.: 09/282,503

[22] Filed: Mar. 31, 1999

[51] Int. Cl.[7] ..... E05C 3/06

[52] U.S. Cl. ..... 292/47; 292/12; 292/197

[58] Field of Search ..... 292/48, 193, 340, 292/47, 46, 49, 197, DIG. 57, 12

[56] References Cited

U.S. PATENT DOCUMENTS

| | | | |
|---|---|---|---|
| 633,552 | 9/1899 | Kenny | 292/241 |
| 2,146,700 | 2/1939 | Peterson | 292/48 |
| 2,315,239 | 3/1943 | Young | 292/47 |
| 2,460,961 | 2/1949 | Wilson | 292/48 |
| 2,493,882 | 1/1950 | Lambert | 292/48 |
| 2,863,688 | 12/1958 | Endter | 292/340 |
| 2,941,831 | 6/1960 | Borsani | 292/79 |
| 3,988,859 | 11/1976 | Peterson | 49/394 |
| 4,209,194 | 6/1980 | Poe | 292/341.18 |
| 4,265,474 | 5/1981 | Poe | 292/241 |
| 4,494,782 | 1/1985 | Lutz | 292/96 |
| 4,691,483 | 9/1987 | Anderson | 52/79.1 |
| 5,086,587 | 2/1992 | Andrews | 49/395 |
| 5,143,412 | 9/1992 | Lindqvist | 292/200 |
| 5,199,369 | 4/1993 | Meyer et al. | 114/117 |
| 5,201,555 | 4/1993 | Meyer | 292/48 |
| 5,333,920 | 8/1994 | De Rover | 292/48 |
| 5,452,927 | 9/1995 | Uyeda | 292/202 |

OTHER PUBLICATIONS

Hartwell Corp. Engineering Drawings, Latch Assy Rotary Hook, H2814, 3 Sheets.

Hartwell Corp. Engineering Drawings, Adjustable Keeper Assy, H2815, 3 Sheets.

*Primary Examiner*—Anthony Knight
*Assistant Examiner*—Clifford B Vaterlaus
*Attorney, Agent, or Firm*—Pretty, Schroeder & Poplawski

[57] ABSTRACT

Disclosed is an increased strength dogging mechanism operable by a handle for releasably securing a door on each side of the door to a structure. The dogging mechanism includes a plurality of dog keepers each having a ramp portion and a seating portion mounted to each side of the door. A dog having a roller is rotatably mounted to engage a cooperatively associated dog keeper. A mounting bolt extends through the structure and through the approximate center of each dog. A drive assembly which is movable by the handle between open and closed positions moves each dog, simultaneously, between unlocked and locked positions. As the dog is rotated to the locked position, the roller of each dog engages the ramp portion of its associated dog keeper and rolls upon the ramp and into the seating portion. The action of the dogs rolling upon the ramps of the dog keepers on each side of the door moves the door perpendicularly into the structure compressing a seal and rigidly secures the door on all sides to the structure to form a waterproof enclosure.

11 Claims, 6 Drawing Sheets

FIG. 2a
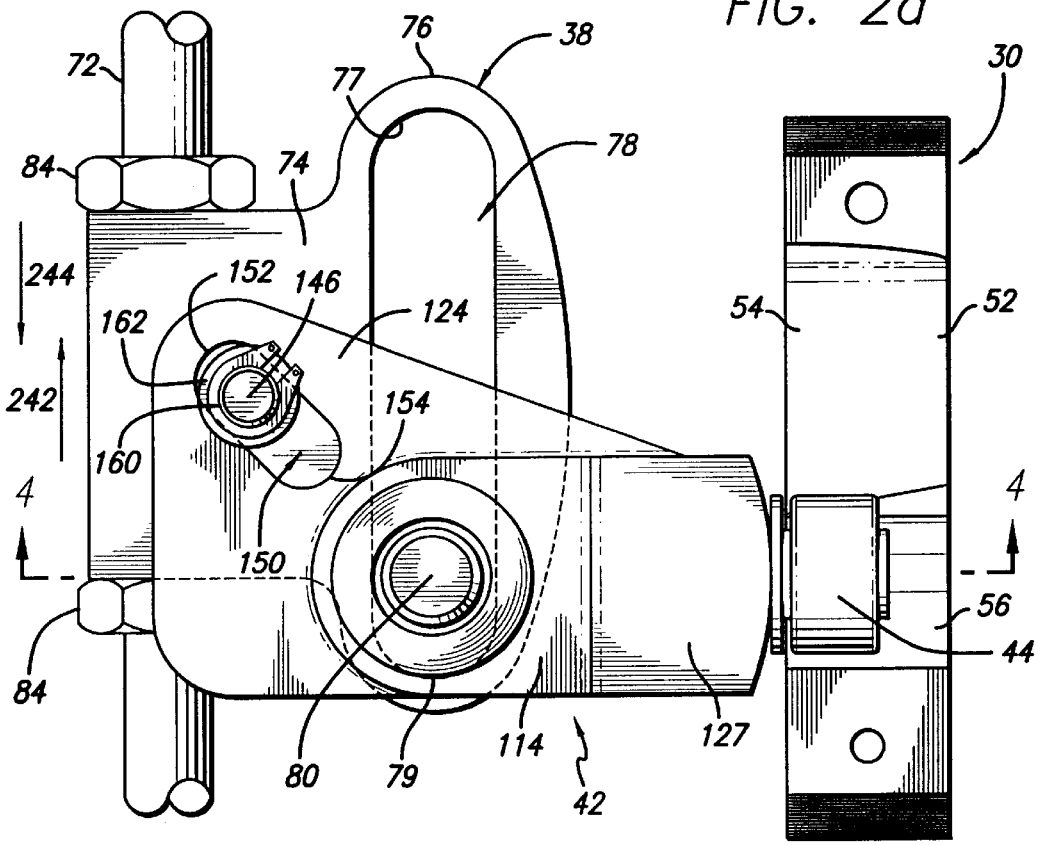
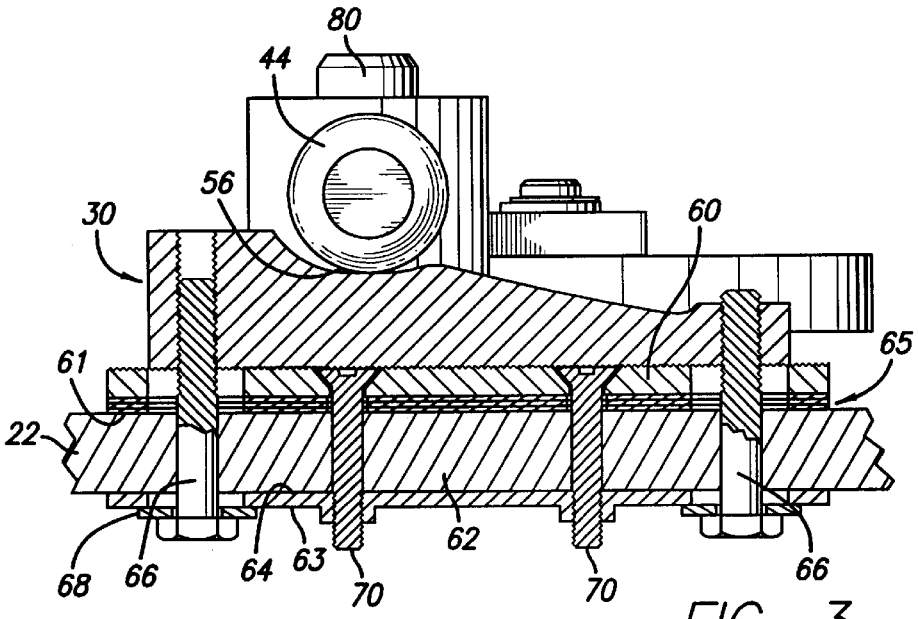
FIG. 3

INCREASED STRENGTH DOGGING MECHANISM

BACKGROUND OF THE INVENTION

1. Field of the Invention

The present invention relates to the mechanical arts. In particular, this invention relates to an increased strength dogging mechanism operable by a handle for releasably securing a door to a structure.

2. Discussion of the Related Art

Doors for use with vehicles, such as ships or aircraft, often include a dogging mechanism operable by an associated handle that secures and releases the door to and from an associated vehicle structure. Often a seal is mounted between the vehicle structure and the door so that when the door is closed the seal compresses and an air-tight and/or waterproof enclosure is created. To compress the seal, the door requires that high closing forces be provided by a dogging mechanism.

One type of prior dogging mechanism utilized for securing a door to a structure on a ship, to provide a waterproof enclosure, is described in U.S. Pat. No. 5,201,555 to Meyer, and includes a plurality of lugs and a plurality of links. The lugs are mounted on a peripheral band along one side of the door. Each lug has a ramp portion and a plateau portion. The links are mounted to flanges of the door frame in cantilever fashion such that they pivotally cooperate with the lugs. A connecting bar is pivotally connected to the links to form a parallel bar linkage. A roller is rotatably connected to each of the links and is disposed to engage the ramp portion of the cooperatively associated lug and roll thereon and onto the plateau portion of the lug as the links are pivoted by the connecting bar. A handle is mounted for rotation between open and closed positions and is connected to the connecting bar. Rotation of the handle to the closed position moves the parallel bar linkage such that the rollers of the links engage the lugs forcing the door into the door frame of the structure and compressing a seal to form a waterproof enclosure.

Although this type of dogging mechanism works well for its intended purpose, it suffers from certain disadvantages. Unfortunately, this sort of dogging mechanism does not provide the required strength to provide for the survivability of the door when it is subjected to large shock loads. Specifically, the cantilevered link arrangement of the dogging mechanism, which only mounts the door on one side to structure, does not provide adequate strength for the door when it is closed.

In view of the above, it should be appreciated that there is a need for an increased strength dogging mechanism that is strong enough to provide for the survivability of the door when it is subjected to large shock loads and that mounts the door on all sides to the structure.

SUMMARY OF THE INVENTION

The present invention resides in an increased strength dogging mechanism that mounts a door on all sides to a structure and provides a significant advantage over known dogging mechanisms in that it provides for the survivability of the door when it is subjected to large shock loads.

The increased strength dogging mechanism of the invention is operable by a handle for releasably securing each side of the door to a structure. The dogging mechanism includes a plurality of dog keepers with at least one dog keeper mounted to each side of the door. Each dog keeper has a ramp portion and a seating portion. In some embodiments, the ramp portion is helically sloped and the seating portion is concave. The dogging mechanism also includes a plurality of guides. A dog is rotatably to mounted to an associated guide for movement between unlocked and locked positions. A roller is rotatably connected to each dog and is disposed to engage a cooperatively associated dog keeper. In some embodiments, a mounting bolt extends through the structure, through each guide, and through each dog, to secure each guide and each dog to the structure creating a stronger dogging mechanism. A drive assembly which is movable by the handle between open and closed positions, moves each dog, simultaneously, between unlocked and locked positions. The drive assembly includes a plurality of rods mounted around the sides of the door with at least one rod slidably mounted on each side of the door and each rod having at least one guide connected to it.

When the handle is rotated between open and closed positions the drive assembly is in turn actuated between open and closed positions. The rods and guides are translated along each side of the door causing the dogs to rotate between unlocked and locked positions. In the unlocked position, the roller of each dog is disengaged from its associated dog keeper. As the dogs are rotated to the locked position, the roller of each dog engages the ramp portion of its associated dog keeper and rolls upon the ramp and into the seating portion. The action of the dogs rolling upon the ramps of the dog keepers on each side of the door moves the door perpendicularly into the structure compressing a seal and securing the door on all sides to the structure to form a waterproof enclosure.

An advantage of the increased strength dogging mechanism is that when each dog rotates to the locked position and the roller seats within the concave seating portion of the associated dog keeper, the dogs assume an over-center position firmly securing the door to the structure. Also, the mounting bolts extending through the structure, each guide, and each dog provide additional support for the dogging mechanism and creates a stronger dogging mechanism. Further, because the door is mounted on all sides to the structure by the dogging mechanism, the door is rigidly fixed to the structure and is able to survive larger shock loads than prior dogging mechanisms.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

FIG. 2*a* is an enlarged top view of a dog and a dog keeper of the dogging mechanism shown in FIG. 1 illustrating the dog in a locked position engaged to the dog keeper.

FIG. 3 is a side view of the dog of FIG. 2*a* with the dog keeper in section.

DESCRIPTION OF THE PREFERRED EMBODIMENTS

Figure 1:
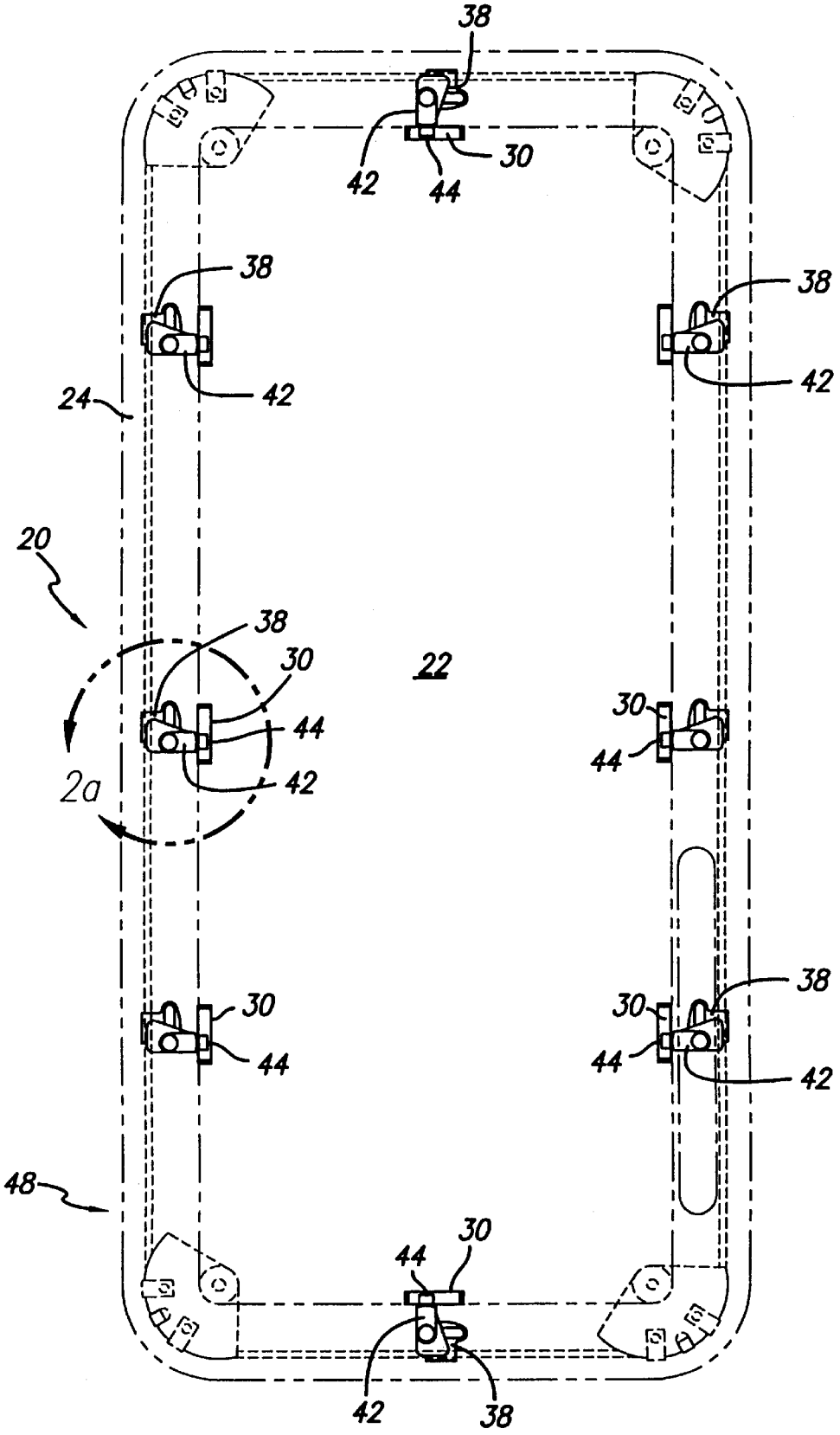
FIG. 1 is an elevational view of the dogging mechanism according to the invention and shows the dogging mechanism securing a door to a door frame.

As shown in the exemplary drawings and with particular reference to FIG. 1, the invention is embodied in a dogging mechanism 20 for releasably securing a door 22 to a door frame 24 of a structure. When the dogging mechanism is closed, the dogging mechanism pulls the door perpendicularly inwards relative to the door frame and compresses a seal (not shown) mounted around the door frame providing a waterproof enclosure. Further, the dogging mechanism rigidly secures the door to the door frame such that door can still function after being subjected to large shock loads. The dogging mechanism includes a plurality of dog keepers 30, a plurality of guides 38, a plurality of dogs 42, a plurality of rollers 44, and a drive mechanism 48.

FIG. 2*a* provides an enlarged view of a representative dog keeper 30 and a representative dog 42 in accordance with the invention. The dog keeper is rectangularly shaped in cross-section and has an exterior surface 52 with a ramp portion 54 and a seating portion 56. In this embodiment, the ramp portion is helically sloped and the seating portion is concave. The dog keeper is disposed to cooperate with the dog such that the roller 44, which is rotatably connected to the dog, engages the exterior surface.

With additional reference to FIG. 3, when the dogging mechanism 20 is closed, the roller seats 44 within the concave seating portion 56 of the dog keeper 30 which is mounted to the door 22. A back plate 60 is interposed between the dog keeper and the interior surface 61 of a flange 62 of the door and a face plate 63 is mounted to the exterior surface 64 of the flange. Also, a set of three shims 65 are mounted between the back plate and the interior surface of the flange.

The dog keeper 30 is mounted to the flange 62 by a pair of bolts 66 extending through the face plate 63, the flange, the back plate 60, and into the dog keeper. Also, a washer 68 is interposed between the bolt and the face plate. Screws 70 additionally secure the back plate and the face plate to the flange.

As seen in FIG. 2*a*, the guide 38 is fixedly connected to a rod 72. The guide 38 has a portion 74 that is rectangularly shaped in cross-section adjacent to a portion 76 that is arch-shaped in cross-section. The arch-shaped portion has an arch-shaped slot 78 formed therethrough having an unlocked end 77 and a locked end 79. The arch-shaped slot accepts a mounting bolt 80 which slidably mounts the guide to the mounting bolt. Additionally referring to FIG. 4, the rectangular portion has a circular opening 82 formed therethrough for accepting the rod. The rod is fixedly connected to the rectangular portion of the guide by a pair of nuts 84 (FIG. 2*a*).

Figure 4:
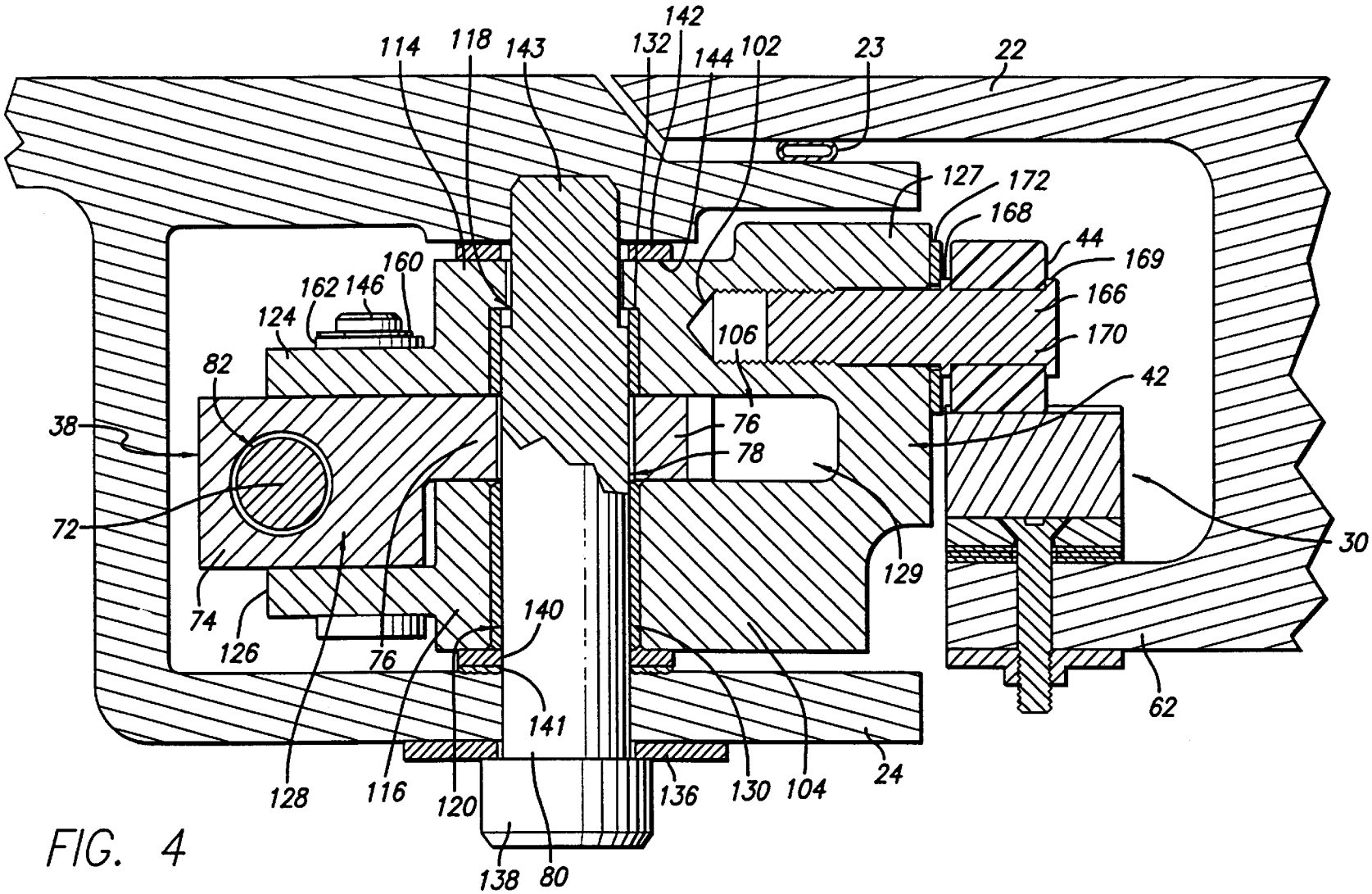
FIG. 4 is a sectional view of the dog and the dog keeper of FIG. 2*a* and also illustrates the dog mounted to the door frame and the dog keeper mounted to the door.

Continuing with reference to FIG. 4, the dog is generally U-shaped in cross-section having opposed first and second portions 102 and 104 and an opening 106 therebetween. Both the first and second portions have central sections 114 and 116 with holes 118 and 120 for accepting the mounting bolt 80. At one end of the central sections, opposed and substantially triangularly shaped sections 124 and 126 (FIG. 2*a*) extend therefrom having reduced widths relative to the central sections. At the other end of the central section of the first portion, a shaft mounting section 127 having a greater width than the adjacent central section, extends therefrom. On the other hand, the second portion, extending from the second triangularly shaped section is of substantially the same width.

The mounting bolt 80 extends through the door frame 24, through the holes 118 and 120 of the central sections 114 and 116 of the dog 42, and through the arch-shaped slot 78 of the guide 38 locating the guide within the opening 106 of the dog. The rectangular portion 74 of the guide fits within a relatively wide portion 128 of the opening and the arch-shaped portion 76 of the guide fits within a relatively narrow portion 129 of the opening. Preferably, the mounting bolt utilized is a shoulder screw. First and second bushings 130 and 132 are mounted around the mounting bolt within the holes of the central sections, respectively, to reduce wear between the mounting bolt and the dog. A washer 136 is located between the head 138 of the mounting bolt and the door frame and a first thrust washer 140 in conjunction with a wave washer 141 are located between the door frame and the dog. A second thrust washer 142 is located around the end 143 of the mounting bolt between the exterior surface 144 of the first portion of the dog and the door frame.

As best seen in FIG. 2*a*, a guide pin 146 rotatably mounts the dog to the guide 38. The opposed triangularly shaped sections 124 and 126 of the first and second portions 102 and 104 each have an aligned guide slot 150 having a first end 152 and a second end 154 for accepting the guide pin 146. The guide pin extends through the slots of the dog and through the rectangular portion 74 of the guide rotatably mounting the dog to the guide. A retaining ring 160 secures the guide pin to the dog and a washer 162 is included between the retaining ring and the dog. Further, bushings surround the guide pin within the slots of the dog to reduce wear.

Figure 2B:
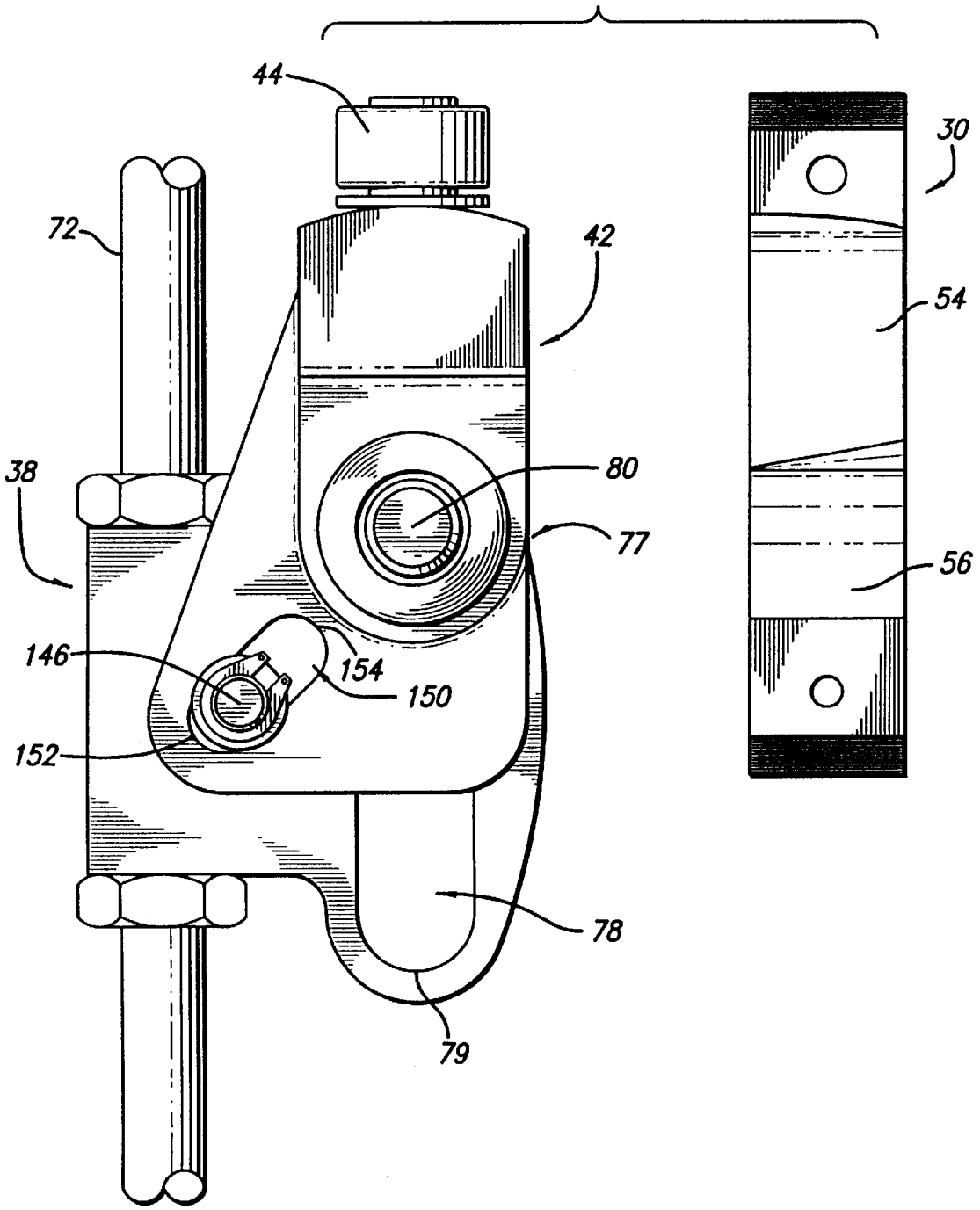
FIG. 2*b* is an enlarged top view of the dog and the dog keeper, similar to FIG. 2*a*, illustrating the dog in an unlocked position disengaged from the dog keeper.

FIG. 2*b* shows a dog 42 in the unlocked position. In the unlocked position, the dog is parallel to the dog keeper 30 and the roller 44 of the dog is disengaged from the dog keeper. The mounting bolt 80 is at the unlocked end 77 of the arch-shaped slot 78 of the guide 38 and the guide pin 146 is at the first end 152 of the guide slot 150 of the dog.

As best seen in FIG. 4, the roller 44 is rotatably connected to the dog 42 by a shaft 166 which extends through the roller and into the shaft mounting section 127 of the dog. The shaft has a first flanged section 168 and a second flanged section 169 with a roller mounting portion 170 therebetween for mounting the roller. The roller is rotatably mounted within the roller mounting portion of the shaft. Further, a washer 172 is mounted between the first flanged section and the shaft mounting section of the dog. The roller is disposed to engage the cooperatively associated dog keeper 30 mounted to the door 22.

Figure 5:
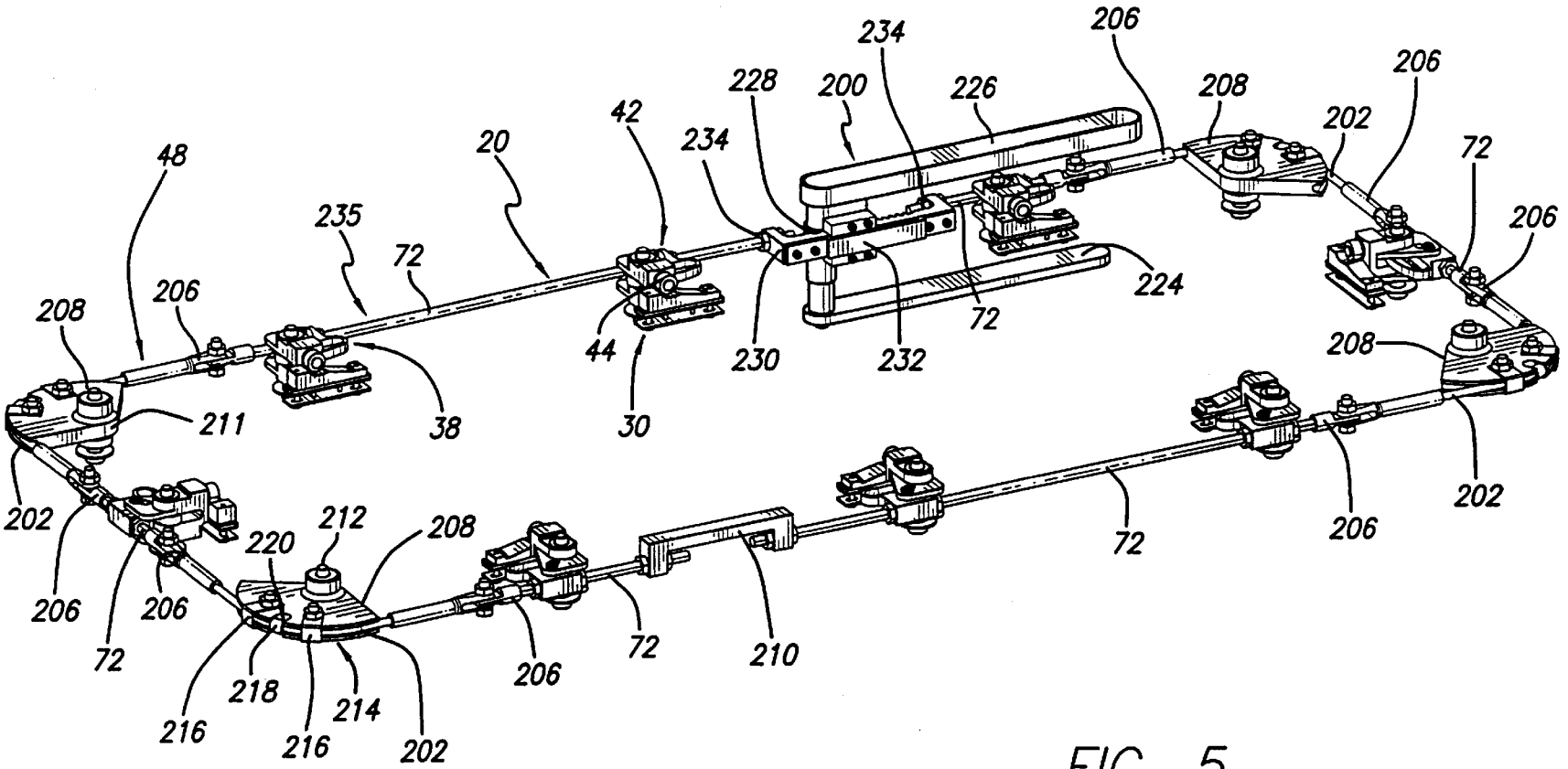
FIG. 5 is a perspective view of the dogging mechanism of FIG. 1.

Referring to FIG. 5, which is a perspective view of the dogging mechanism 20, the drive mechanism 48 is operable by a handle assembly 200. In this representative embodiment, the drive mechanism includes six rods 72, four cables 202, eight fork end couplers 206, four heels 208, and a turnbuckle 210.

The drive mechanism 48 connects the dogging mechanism 20 around each of the four comers of the door 22 (as shown in FIG. 1) so that the door can be secured by the dogging mechanism on all four sides of the door to the door frame 24. For example, with reference to the lower right hand comer of the dogging mechanism shown in FIG. 5, a rod 72 is connected by a fork end coupler 206 to a cable 202. The cable wraps around the heel 208 and connects to another fork end coupler which couples the cable to another rod. Preferably, the cable is heated and cold worked to increase its strength.

The heel 208 rotates to accommodate the movement of the rods 72 as the drive mechanism 48 is moved by a handle assembly 200 between open and closed positions. The heel is shaped as a segment of a circle and is rotatably mounted at its apex 211 to the door 22 by a shoulder bolt 212. The heel has a semi-circular track 214 which accepts the cable 202. The heel includes two cable safeties 216 which are U-shaped brackets mounted around the track of the heel that prevent the cable from riding out of the track. The heel also includes a button stop 218 swaged to the cable which fits within a button slot 220 of the heel. The button stop abuts the walls of the button slot and ensures that as the cable is moved the heel rotates with the cable. Also, a turnbuckle 210 is mounted between a pair of rods for adjusting the tension of the dogging mechanism 20.

In the representative embodiment shown in FIG. 5, the handle assembly 200 has an interior handle 224 and an exterior handle 226 mounted to one another by a shaft (not shown) so that the interior and exterior handle rotate in unison. Therefore, either handle can be used to actuate the drive mechanism 48 to lock or unlock the dogging mechanism 20. The handle assembly includes a pinion 228 having gears mounted around the shaft for engaging and moving a rack 230 having interlocking gears which is slidably mounted to the handle assembly. Rotation of the handles between closed and open positions rotates the shaft and the pinion resulting in the rack correspondingly moving between closed and open positions. A U-shaped handle stop 232 mounted to the rack limits the movement of the rack and limits the movement of the handle assembly to approximately 180 degrees. The rack is connected at each of its ends by nuts 234 to an associated rod 72 so that rotation of the handles results in the translation of the rack and the rods.

With reference to FIG. 5, the method of use and operation of the dogging mechanism 20 can be seen to proceed as follows.

The rotation of the handle assembly 200 results in the rack 230 moving laterally which in turn translates each of the rods 72 laterally with respect to the door. The drive assembly 48 translates the movement of the rods on the side 235 of the dogging mechanism 20 including the handle assembly to the rods on each of the other sides of the dogging mechanism. As the rods on the side 235 translate laterally, the cables 202, which are mounted around each heel 208 and are coupled between the adjacent rods on the adjacent sides of the dogging mechanism by the couplers 206, force each heel 208 to rotate about its associated shoulder bolt 212. The rotation of the heels causes each rod on each side of the dogging mechanism to move laterally in the same direction. Thus, the rotation of the handle assembly forces the rods on each side of the dogging mechanism to move laterally in the same direction resulting in each guide 38, fixedly mounted to the rods, to likewise move laterally in the same direction.

Figure 2C:
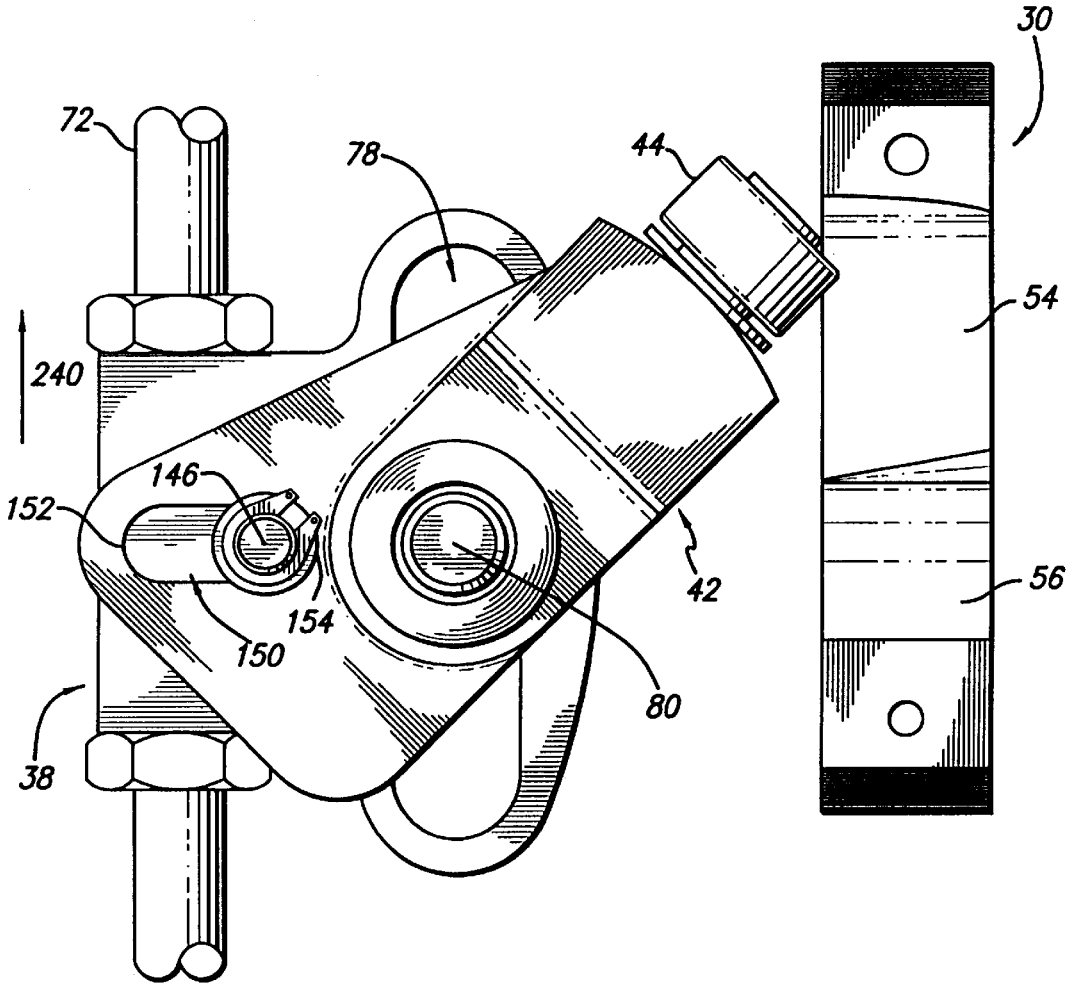
FIG. 2*c* is an enlarged top view of the dog and the dog keeper illustrating the dog rotating from the unlocked position of FIG. 2*b*, towards the locked position of FIG. 2*a*, and the dog engaging the dog keeper.

As the handle assembly 200 is rotated from the open position towards the closed position, approximately 90 degrees, each rod 72 translates laterally in the same direction causing each guide 38 to also translate laterally from the position of FIG. 2*b* to the position of FIG. *c*, as indicated by the arrow 240. As the guide moves laterally the arch-shaped slot 78 of the guide moves along the mounting bolt 80 and the guide pin 146 moves along the guide slot 150 of the dog 42 from the first end 152 (FIG. 2*b*) to the second end 154 (FIG. 2*c*) forcing the dog to rotate about the mounting bolt. As the dog rotates the roller 44 engages the helically sloped ramped portion 54 of the dog keeper 30 and rolls upon the ramp towards the concave seating portion 56.

As the handle assembly 200 is rotated a full 180 degrees to the closed position, each rod 72 and each guide 38 continue to translate laterally in the same direction, from the position of FIG. *c* to the position of FIG. 2*a*, as indicated by arrow 242. As the guide moves laterally the arch-shaped slot 78 of the guide moves along the mounting bolt 80 to its locked end 79 and the guide pin 146 moves along the guide slot 150 of the dog 42 from the second end 154 (FIG. 2) back to the first end 152 (FIG. 2*a*) forcing the dog to rotate about the mounting bolt to its locked position. In the locked position, the dog is perpendicular relative to the dog keeper 30 and the roller 44 seats within the concave seating portion 56. The movement of the roller of the dog rolling upon the helically sloped ramp portion and into the concave seating portion translates the door 22 perpendicularly inwards towards the door frame 24 and compresses a seal 23 (as shown in FIG. 4) forming a waterproof enclosure. The rolling contact between the roller and the helically sloped ramp allows for line contact over the entire dog rotation reducing friction and wear so that the majority of the of the closing force is applied to the door.

An advantage of the increased strength dogging mechanism 20 is that when each dog 42 rotates to the locked position and the roller 44 seats within the concave seating portion 56 of the associated dog keeper 30, the dogs assume an over-center position firmly securing the door 22 to the door frame 24. Also, the mounting bolts 80 extending through the door frame, each arch-shaped slot 78 of each guide 38, and the approximate center of each dog, provide additional support for the dogging mechanism creating a very strong dogging mechanism. This additional support of the mounting bolts provides for extra survivability when the door is subjected to large shock loads. Further, because the door is mounted on all sides to the door frame by the dogging mechanism, the door is rigidly fixed to the door frame, and is able to survive larger shock loads than prior dogging mechanisms.

The process by which the dogging mechanism 20 opens the door 22, by releasing the door from its door frame 24, is simply the reverse of the process by which the dogging mechanism closes and secures the door to its door frame. The handle assembly 200 is simply rotated 180 degree back to its closed position. The rotation of the handle assembly causes the rack 230 and the rods 72 to move laterally in the opposite direction to that of the closing of the dogging mechanism. As previously described, the drive assembly 48 translates the movement of the rods on the side 235 of the dogging mechanism 20 including the handle assembly, to the rods on each of the other sides of the dogging mechanism. As the rods on the side 235 translate laterally, the cables 202 force each heel 208 to rotate about its associated shoulder bolt 212, in the opposite direction to that of the closing of the dogging mechanism, resulting in each rod and each guide 38 on each side of the dogging mechanism to move laterally in the same direction.

With reference to FIG. 2*a*, as the handle assembly 200 is rotated 180 degrees back to its open position, each rod 72 and each guide 38 translate laterally in the same and opposite direction of arrow 242, as indicated by arrow 244. The dog 42 moves from the position of FIG. 2*a* to the position of FIG. 2*b*. As the guide moves laterally the arch-shaped slot 78 of the guide moves along the mounting bolt 80 from the position of FIG. 2*a*, in which the mounting bolt abuts the locked end 79 of the arch-shaped slot, to the position of FIG. 2*b*, in which the mounting bolt abuts the unlocked end 77. Simultaneously, the guide pin 146 moves along the guide slot 150 of the dog from the position of FIG. 2*a*, where the guide pin abuts the first end 152 of the guide slot, to the position of FIG. *c*, where the guide pin abuts the second end 154 of the guide slot, and to the position of FIG. 2*b* where the guide pin again abuts the first end of the guide slot. This motion of guide pin forces the dog to rotate about the mounting bolt to the unlocked position of FIG. 2*b*. As the dog rotates to the unlocked position, the roller 44 moves out of the concave seating portion 56 and rides along the helically sloped ramp portion 54 and off of the dog keeper such that the dog is rotated parallel to the dog keeper as shown in FIG. 2*b*. The movement of the roller of the dog riding down the helically sloped ramp and off the dog keeper translates the door 22 perpendicularly outwards relative to the door frame 24, decompressing the seal 23, and releases the door from the door frame. The door can then be pivoted open.

Those skilled in the art will recognize that other modifications and variations can be made in the increased strength dogging mechanism of the invention and in the construction and operation of the dogging mechanism without departing from the scope or spirit of this invention. For example, it should be understood that this device could also be used to secure a variety of different doors on a variety of different vehicle structures, as well as, stationary structures. With such possibilities in mind, the invention is defined with reference to the following claims.

We claim:

1. A dogging mechanism operable by a handle for releasably securing a door on each side of the door to a structure, the dogging mechanism comprising:

a plurality of dog keepers having a ramp portion and a seating portion with at least one dog keeper for attachment to each side of the door;

a plurality of guides;

a dog rotatably mounted to each guide for movement between unlocked and locked positions;

a roller rotatably connected to each dog and disposed to engage a cooperatively associated dog keeper; and a drive assembly for movement by the handle between open and closed positions, the drive assembly including a plurality of rods connected to the guides with at least one rod slidably mounted for attachment to each side of the door so that when the drive assembly is moved between open and closed positions the rods and the guides are translated causing the dogs to rotate between the unlocked position, in which the roller of each dog is disengaged from its associated dog keeper, to the locked position, in which the roller of each dog engages the ramp portion of its associated dog keeper rolling thereon and onto the seating portion for securing the door on all sides to the structure.

2. The dogging mechanism of claim 1, further comprising a plurality of mounting bolts, each mounting bolt extending through each guide and each dog for securing each guide and each dog to the structure.

3. The dogging mechanism of claim 2, further comprising a slot within each guide, each mounting bolt extending through the slot within each guide for slidably securing each guide to the structure.

4. The dogging mechanism of claim 3, wherein the slot is arch-shaped.

5. The dogging mechanism of claim 1, wherein the ramp of the dog keeper is helically sloped.

6. The dogging mechanism of claim 1, wherein the seating portion of the dog keeper is concave.

7. The dogging mechanism of claim 1, further comprising a guide pin mounted through a guide slot in the dog and through the guide which rotatably mounts the dog to the guide.

8. A dogging mechanism operable by a handle for releasably securing a door on each side of the door to a structure, the dogging mechanism comprising:

a plurality of dog keepers having a ramp portion and a seating portion with at least one dog keeper for attachment to each side of the door;

a plurality of guides;

a dog rotatably mounted to each guide for movement between unlocked and locked positions;

a plurality of mounting bolts, each mounting bolt extending through each guide and each dog for securing each guide and each dog to the structure;

a roller rotatably connected to each dog and disposed to engage a cooperatively associated dog keeper; and a drive assembly for movement by the handle between open and closed positions, the drive assembly including a plurality of rods connected to the guides with at least one rod slidably mounted for attachment to each side of the door so that when the drive assembly is moved between open and closed positions the rods and the guides are translated causing the dogs to rotate between the unlocked position, in which the roller of each dog is disengaged from its associated dog keeper, to the locked position, in which the roller of each dog engages the ramp portion of its associated dog keeper rolling thereon and onto the seating portion for securing the door on all sides to the structure.

9. The dogging mechanism of claim 8, further comprising a slot within each guide, each mounting bolt extending through the slot within each guide for slidably securing each guide to the structure.

10. The dogging mechanism of claim 9, wherein the slot is arch-shaped.

11. A dogging mechanism operable by a handle for releasably securing a door on each side of the door to a structure, the dogging mechanism comprising:

a plurality of dog keepers having a ramp portion and a seating portion with at least one dog keeper for attachment to each side of the door;

a plurality of guides each with an arch-shaped slot;

a dog;

a guide pin mounted through a guide slot in the dog and through the guide which rotatably mounts the dog to the guide to allow movement between unlocked and locked positions;

a plurality of mounting bolts, each mounting bolt extending through each dog and the slot within each guide and for securing each dog and each guide to the structure;

a roller rotatably connected to each dog and disposed to engage a cooperatively associated dog keeper; and a drive assembly for movement by the handle between open and closed positions, the drive assembly including a plurality of rods connected to the guides with at least one rod slidably mounted for attachment to each side of the door so that when the drive assembly is moved between open and closed positions the rods and the guides are translated causing the dogs to rotate between the unlocked position, in which the roller of each dog is disengaged from its associated dog keeper, to the locked position, in which the roller of each dog engages the ramp portion of its associated dog keeper rolling thereon and onto the seating portion for securing the door on all sides to the structure.

* * * * *